US010292439B2

(12) United States Patent
Martel

(10) Patent No.: US 10,292,439 B2
(45) Date of Patent: May 21, 2019

(54) STRETCHABLE STRAP HAVING A PADDING ELEMENT

(71) Applicant: BAUER HOCKEY CORP., St-Jerome (CA)

(72) Inventor: Pascal Martel, Montreal (CA)

(73) Assignee: BAUER HOCKEY, LLC, Exeter, NH (US)

( * ) Notice: Subject to any disclaimer, the term of this patent is extended or adjusted under 35 U.S.C. 154(b) by 432 days.

(21) Appl. No.: 14/169,589

(22) Filed: Jan. 31, 2014

(65) Prior Publication Data

US 2015/0216240 A1 Aug. 6, 2015

(51) Int. Cl.
*A41D 13/05* (2006.01)

(52) U.S. Cl.
CPC ..... *A41D 13/0568* (2013.01)

(58) Field of Classification Search
CPC ..... A41D 13/0568; A41D 13/0518; A41D 13/088; A41D 2600/10; A63B 71/12; A63B 2102/24; A41F 15/005
USPC ..... 428/128; 450/86
See application file for complete search history.

(56) References Cited

U.S. PATENT DOCUMENTS 1,310,477 A * 7/1919 Hartman ..... A63B 71/12 2/462
3,166,760 A * 1/1965 Rasmussen ..... A63B 71/12 2/462
4,079,464 A * 3/1978 Roggin ..... F41H 1/02 2/2.5
4,453,271 A * 6/1984 Donzis ..... A41D 13/0153 2/2.5
4,512,037 A * 4/1985 Vacanti ..... A63B 71/08 2/22
4,550,869 A * 11/1985 Johnson ..... A61F 5/3738 224/257
4,590,622 A * 5/1986 Wolfe ..... A41D 13/0512 2/16
4,612,935 A * 9/1986 Greifer ..... A41F 15/007 2/268
4,880,419 A * 11/1989 Ness ..... A61F 13/53427 604/368
4,924,103 A * 5/1990 Stein ..... G21F 3/03 2/411
5,046,488 A 9/1991 Schiek, Sr.
5,073,985 A * 12/1991 Stone ..... F41H 1/02 2/2.5
5,324,244 A * 6/1994 Miller ..... A63B 21/4021 482/106
5,349,706 A 9/1994 Keer
(Continued)

*Primary Examiner* — Richale Quinn
*Assistant Examiner* — Anne Kozak

(57) ABSTRACT

A strap for a protective sport garment wearable by a wearer, the garment comprising at least first and second parts separated by a space. The strap has first and second layers made of stretchable material a padding element confined therein for offering impact protection. The strap also has a first end portion affixed to one of the first and second parts and a second end portion detachably affixed at a selected location on the other one of the first and second parts. In use, the strap is movable between first and second lengths for allowing the second end portion of the strap to be affixed at the selected location for allowing adjustability of the first and second parts.

51 Claims, 10 Drawing Sheets

(56) References Cited

U.S. PATENT DOCUMENTS 5,398,339 A * 3/1995 Wagner ..... A63B 71/12 2/268
5,421,809 A 6/1995 Rise
5,423,087 A * 6/1995 Krent ..... A41D 13/0156 2/267
5,431,318 A * 7/1995 Garcia ..... F41C 33/00 2/2.5
5,445,858 A * 8/1995 Nwoko ..... A45F 3/12 428/174
5,503,894 A * 4/1996 Brown ..... B68C 1/14 119/792
5,507,681 A * 4/1996 Smith ..... A41F 15/007 2/243.1
5,513,658 A * 5/1996 Goseki ..... A61F 5/0109 128/882
5,539,931 A * 7/1996 Fizer ..... A41F 15/007 2/267
5,557,802 A * 9/1996 Wickert ..... A63B 71/08 2/462
5,558,556 A * 9/1996 Froehlich ..... A41F 15/007 2/267
5,614,303 A * 3/1997 Baigas, Jr. ..... B32B 5/26 442/247
5,623,728 A * 4/1997 Wagner ..... A63B 71/12 2/16
5,626,507 A * 5/1997 Gillen ..... A41C 3/105 2/268
5,691,028 A * 11/1997 Curtis ..... A41F 15/007 2/268
5,745,925 A * 5/1998 Ghilardi ..... G21F 3/02 2/338
5,803,792 A * 9/1998 Roush ..... A41F 15/007 2/267
5,975,984 A * 11/1999 Tart ..... A41F 15/007 2/268
5,984,762 A * 11/1999 Tedeschi ..... A41F 15/00 2/243.1
6,070,273 A * 6/2000 Sgro ..... A41D 13/0153 2/231
6,122,768 A * 9/2000 McCrane ..... A41D 13/065 2/16
6,233,737 B1 * 5/2001 Ditchfield ..... F41H 1/02 2/2.5
6,247,188 B1 * 6/2001 Beland ..... A63B 71/12 2/461
6,283,821 B1 * 9/2001 Wang ..... A41F 15/002 2/311
6,345,396 B1 * 2/2002 Schuler ..... A41D 13/0568 2/465
6,374,409 B1 * 4/2002 Galy ..... A41D 13/065 2/24
6,397,783 B1 * 6/2002 Koch ..... A01K 27/00 119/792
6,675,391 B2 * 1/2004 Morrison ..... A63B 21/065 2/102
D493,258 S * 7/2004 Beland ..... D29/100
6,823,870 B1 * 11/2004 Hill ..... A61F 5/3776 128/869
6,880,347 B1 * 4/2005 Stam ..... A41D 13/0568 128/878
6,925,652 B2 * 8/2005 Feng ..... B63C 11/08 2/2.15
7,086,926 B2 * 8/2006 Falla ..... A41F 15/007 2/267
7,147,538 B2 * 12/2006 Cano ..... A41F 15/007 2/267
7,222,372 B1 * 5/2007 Bruckart ..... A41C 3/08 2/106
7,225,477 B1 * 6/2007 Rodriguez ..... A63B 71/12 2/461
7,434,301 B1 * 10/2008 Johnson ..... A41F 15/007 29/45
7,536,728 B1 * 5/2009 Leathers ..... F41H 1/02 2/2.5
7,673,777 B2 3/2010 Gleason, Jr.
7,785,171 B1 * 8/2010 Baker ..... A41F 15/02 2/338
7,927,179 B2 * 4/2011 Kaye ..... A41F 15/02 450/86
7,992,223 B2 8/2011 Manzo
8,067,759 B1 * 11/2011 Swartz ..... G21F 3/02 2/102
8,082,602 B2 * 12/2011 Crelinsten ..... A41D 13/05 2/267
8,109,892 B2 * 2/2012 Brown ..... A61F 13/085 156/73.5
8,226,453 B2 * 7/2012 Lau ..... A41F 15/005 2/338
8,261,699 B2 * 9/2012 Cho ..... A01K 27/002 119/792
2002/0023709 A1 * 2/2002 Tedeschi ..... A41F 15/007 156/213
2003/0040256 A1 * 2/2003 Waitz ..... A41C 3/12 450/86
2004/0003448 A1 * 1/2004 Morrow ..... A63B 71/12 2/92
2004/0154083 A1 * 8/2004 McVicker ..... A41D 13/05 2/455
2004/0194194 A1 * 10/2004 McNeil ..... A42B 3/0473 2/421
2004/0205881 A1 * 10/2004 Morrow ..... A41D 13/0153 2/459
2005/0086728 A1 * 4/2005 Tobergte ..... A63B 71/12 2/459
2006/0053535 A1 * 3/2006 Ide ..... A63B 71/12 2/459
2006/0178224 A1 * 8/2006 DuFour ..... A63B 69/0059 473/276
2007/0151004 A1 * 7/2007 Brassill ..... A63B 71/12 2/461
2007/0163025 A1 * 7/2007 Godshaw ..... A41D 13/0568 2/24
2007/0192922 A1 * 8/2007 Dancyger ..... A41D 13/065 2/24
2007/0234467 A1 * 10/2007 Leach ..... A41B 11/12 2/227
2008/0134419 A1 * 6/2008 Kalaam ..... A41D 13/00 2/463
2009/0077703 A1 * 3/2009 Gabry ..... A41D 13/05 2/16
2009/0126065 A1 * 5/2009 Chiang ..... A41D 13/065 2/24
2009/0235440 A1 * 9/2009 Udelhofen ..... A63B 71/12 2/462
2010/0072091 A1 * 3/2010 Quartarone ..... A63B 55/408 206/315.3
2010/0093504 A1 * 4/2010 Del Monte ..... A63B 21/065 482/105
2010/0192287 A1 * 8/2010 Kraemer ..... A63B 71/12 2/459
2010/0281607 A1 * 11/2010 Kordecki ..... A41D 13/0512 2/462
2010/0319096 A1 * 12/2010 Scott ..... A41D 13/08 2/16
2011/0010829 A1 * 1/2011 Norman ..... A41D 13/0512 2/459
2012/0198606 A1 * 8/2012 Bowden ..... A41D 13/0512 2/462
2012/0311769 A1 * 12/2012 Lee ..... A63B 71/12 2/272
2013/0014318 A1 * 1/2013 Jourde ..... A63B 71/12 2/459
2013/0086775 A1 * 4/2013 Raymond ..... A44B 18/00 24/448
2013/0104302 A1 * 5/2013 Fream ..... A41D 13/0512 2/461
2013/0139294 A1 * 6/2013 Zetune ..... A41D 19/01505 2/163

(56) References Cited

U.S. PATENT DOCUMENTS

| | | | | |
|---|---|---|---|---|
| 2013/0167291 | A1* | 7/2013 | Skottheim | A41D 13/015 2/459 |
| 2013/0227755 | A1* | 9/2013 | Bisaillon | A41D 13/081 2/20 |
| 2013/0276218 | A1* | 10/2013 | Parisi, Jr. | F41H 1/02 2/463 |
| 2013/0291294 | A1* | 11/2013 | Legace | A63B 71/12 2/463 |
| 2013/0312152 | A1* | 11/2013 | Paul | A41D 13/015 2/16 |
| 2014/0007330 | A1* | 1/2014 | Smith | A63B 71/08 2/463 |
| 2014/0020161 | A1* | 1/2014 | Mason | A41D 13/015 2/462 |
| 2014/0245528 | A1* | 9/2014 | Williams | A63B 71/12 2/461 |
| 2014/0289938 | A1* | 10/2014 | Brown | A41D 13/015 2/455 |
| 2015/0216240 | A1* | 8/2015 | Martel | A41D 13/0568 2/455 |
| 2015/0264987 | A1* | 9/2015 | Morin | A41D 13/0568 2/16 |

* cited by examiner

STRETCHABLE STRAP HAVING A PADDING ELEMENT

FIELD OF THE INVENTION

The present invention relates to stretchable adjustable straps for securing a protective sport garment to a wearer and offering better protection to the wearer.

BACKGROUND OF THE INVENTION

Traditional straps used in protective sport garments for adjusting or securing different parts of the garment to a wearer such as a hockey, lacrosse, football, or baseball player provide little protection to the player. These straps are generally made of fabric and are not optimal for absorbing impact such as that produced by an object (e.g. a ball, a puck or a stick) hitting the player. As a result, when the player wears the protective sport garment (e.g. shoulder pads, elbow pads, leg pads, etc.), the location of the strap is generally a point at which the player is vulnerable and where less protection is offered to the player.

There is therefore a need for a strap that is affixed at its first end portion to a first part of the protective sport garment and that is detachably affixed at its second end portion to a second part of the protective sport garment for allowing adjustability of the first and second parts of the garment on the wearer (player) while offering better protection to the wearer. The strap is made of a stretchable material such that the strap is movable between first and second lengths. Also, once affixed, the strap conforms to the wearer's body.

SUMMARY OF THE INVENTION

As embodied and broadly described herein, the present invention provides a strap for a protective sport garment wearable by a wearer, the garment comprising at least first and second parts separated by a space, the strap comprising: first and second layers made of stretchable material, the first and second layers defining a hollow space therebetween; and a padding element confined in the hollow space for offering impact protection to the wearer wearing the garment; wherein the strap comprises a first end portion affixed to one of the first and second parts and a second end portion detachably affixed at a selected location on the other one of the first and second parts, and wherein, in use, the strap is movable between first and second lengths for allowing the second end portion of the strap to be affixed at the selected location for allowing adjustability of the first and second parts.

In accordance with another broad aspect, the invention provides a strap for a protective sport garment wearable by a wearer, the garment comprising at least first and second parts separated by a space, the strap comprising: first and second layers made of stretchable material, the first and second layers defining a hollow space therebetween; and first and second padding elements confined in the hollow space for offering impact protection to the wearer wearing the garment; wherein the strap comprises a first end portion affixed to one of the first and second parts and a second end portion detachably affixed at a selected location on the other one of the first and second parts, the first padding element having a proximal end portion and a distal end portion that is adjacent the second end portion of the strap and the second padding element having a proximal end portion adjacent the first end portion of the strap, the second padding element defining a cavity for at least partially receiving the first padding element; and wherein, in use, the strap is movable between first and second lengths for allowing the second end portion to be affixed at the selected location for allowing adjustability of the first and second parts while the proximal end portion of the first padding element remains within the cavity defined by the second padding element when the strap is moved from the first length to the second length.

In accordance with a further broad aspect, the invention provides a strap for a protective sport garment wearable by a wearer, the garment comprising at least first and second parts separated by a space, the strap comprising: first and second layers made of stretchable material, the first and second layers defining a hollow space therebetween; and first and second padding elements confined in the hollow space for offering impact protection to the wearer wearing the garment; wherein the strap comprises a first end portion affixed to one of the first and second parts and a second end portion detachably affixed at a selected location on the other one of the first and second parts, the first padding element having a distal end portion adjacent the second end portion of the strap and the second padding element having a proximal end portion adjacent the first end portion of the strap; wherein, in use: the first and second padding elements define a first overlap when the first and second padding elements are in a first position and the strap is in a first length; the strap is movable between the first length and a second length for allowing the second end portion to be affixed at the selected location for allowing adjustability of the first and second parts; and the first and second padding elements define a second overlap when the first and second padding elements are in a second position and the strap is in the second length.

BRIEF DESCRIPTION OF THE DRAWINGS

A detailed description of the embodiments of the present invention is provided herein below, by way of example only, with reference to the accompanying drawings, in which.

DETAILED DESCRIPTION OF THE EMBODIMENTS

Figure 1:
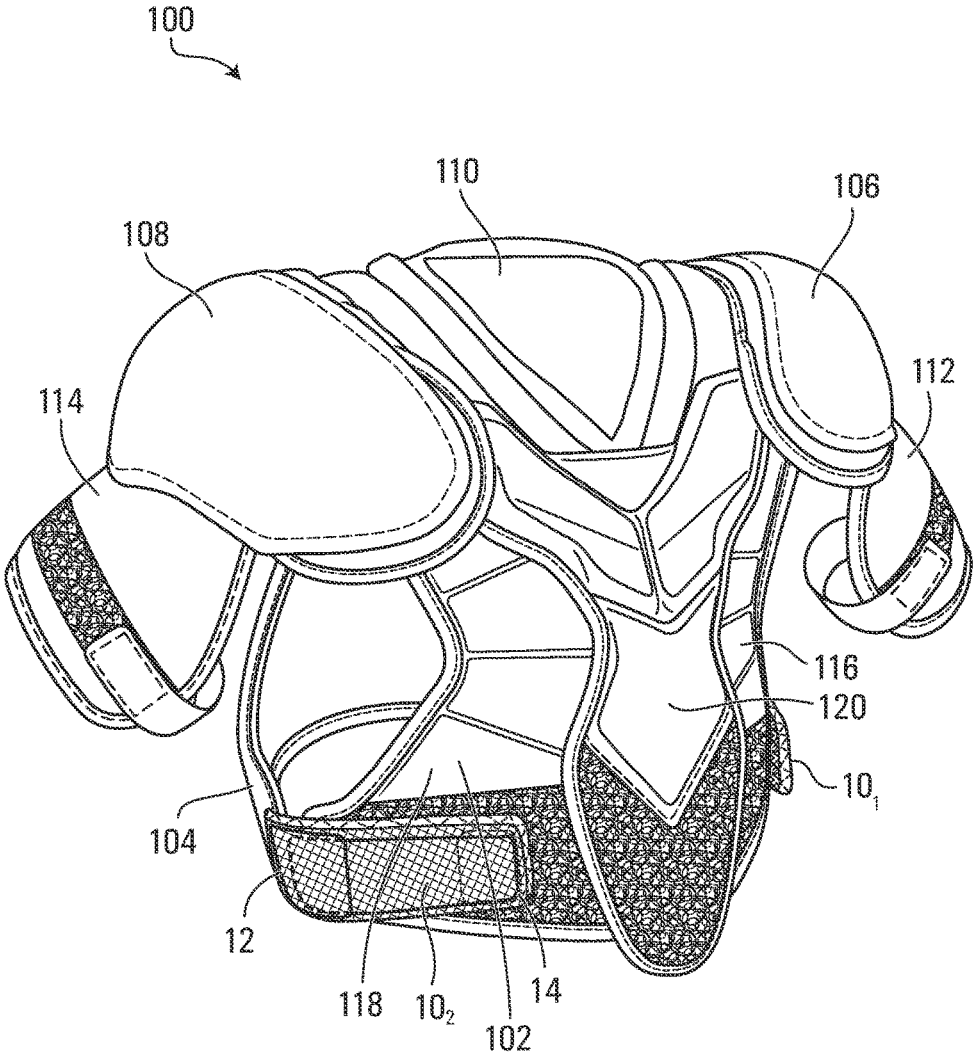
FIG. 1 is a perspective view of a protective sport garment with left and right straps constructed in accordance with a first embodiment of the invention.

To facilitate the description, any reference numerals designating an element in one figure will designate the same element if used in any other figures. In describing the embodiments, specific terminology is resorted to for the sake of clarity but the invention is not intended to be limited to the specific terms so selected, and it is understood that each specific term comprises all equivalents. Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure. Similarly, the terms "inwardly," "outwardly" and "radially" generally refer to the orientation of a surface relative to its axis of elongation, or axis of rotation, as appropriate.

Figure 2:
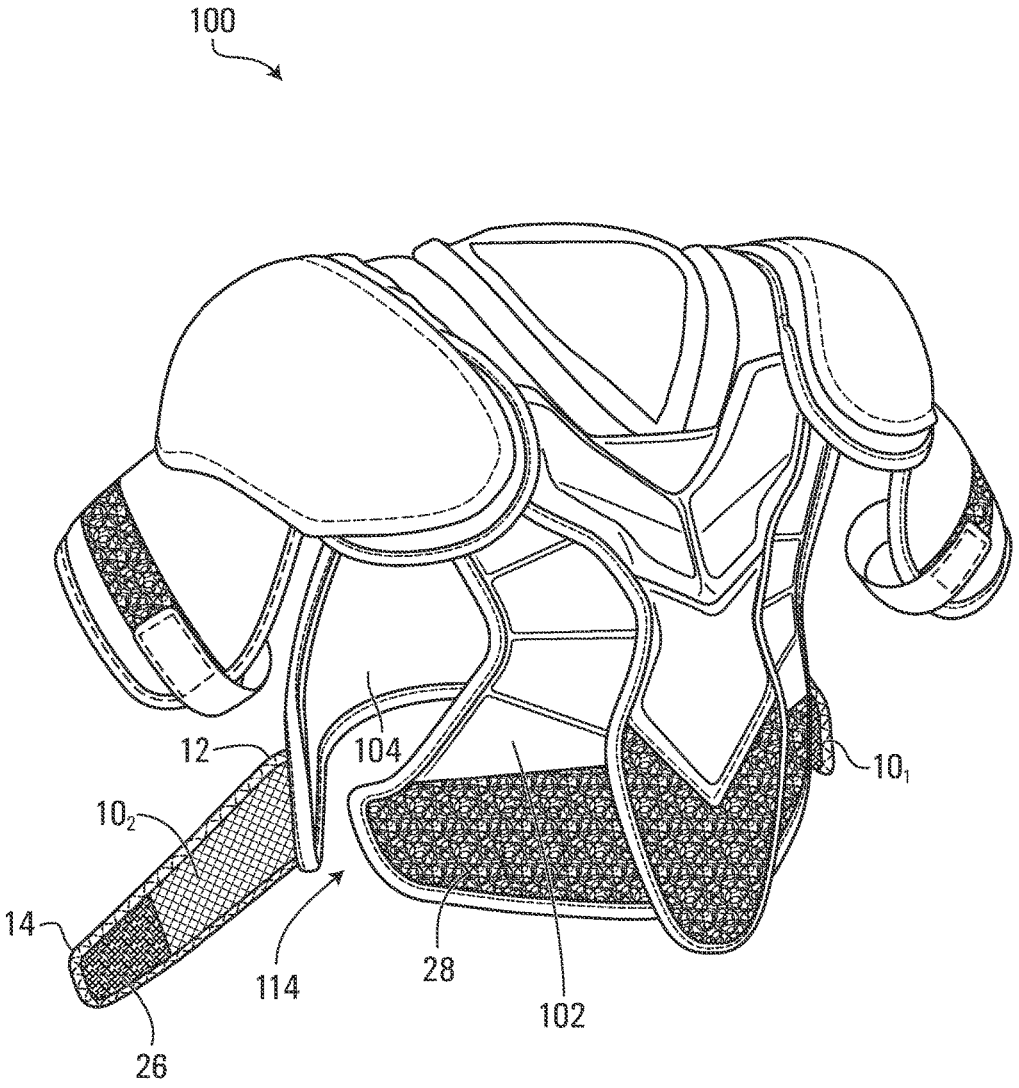
FIG. 2 is a perspective view of the protective sport garment of FIG. 1, with the right strap shown in a released position.

FIGS. 1 and 2 show an example of a protective sport garment 100 with left and right straps $\mathbf{10}_1$, $\mathbf{10}_2$, each strap being constructed in accordance with a first embodiment of the invention. The protective sport garment 100 is a protective sport garment wearable by a wearer when playing a sport (e.g. hockey, lacrosse, football or baseball) to protect his/her body against injury. In this embodiment, the protective sport garment 100 is shoulder pads for upper body protection of the wearer. More particularly, in this embodiment, the wearer is a hockey or a lacrosse player playing hockey or lacrosse such that the shoulder pads 100 are hockey or lacrosse shoulder pads. Although the straps $\mathbf{10}_1$, $\mathbf{10}_2$ shown in the figures are incorporated in hockey or lacrosse shoulder pads 100, it is understood that the straps $\mathbf{10}_1$, $\mathbf{10}_2$ can be used for any protective sport garment (e.g. elbow pad, leg pad) adapted to be worn by hockey, lacrosse, football or baseball players.

The shoulder pads 100 comprise a front part 102 defining a neck opening 110 for receiving a neck of the player, a rear part 104 and left and right shoulder protectors with left and right shoulder caps 106, 108. A front-back direction, a left-right direction, and a top-bottom direction of the shoulder pads 100 are respectively parallel to the front-back axis, the left-right axis, and the vertical axis of the upper body of the player. In this embodiment, the shoulder pads 100 also comprise left and right arm protectors 112, 114. The front part 102 may comprise left and right panels 116, 118 for at least partially covering the left and front sides of the player's thorax or chest and a middle panel 120 for at least partially covering for covering the middle region (sternum) of the player's thorax or chest.

With reference to FIGS. 1 to 7, the shoulder pads 100 comprise the left and right straps $\mathbf{10}_1$, $\mathbf{10}_2$ for allowing the player to adjust a fit of the shoulder pads 100. More particularly, each of the straps $\mathbf{10}_1$, $\mathbf{10}_2$ is affixed at its first (proximal) end portion to a first part (rear part 104) of the shoulder pads 100 and is detachably affixed at its second (distal) end portion to a second part (front part 102) of the shoulder pads 100 for allowing adjustability of the first and second parts (back and front parts 104, 102) on the player when the player is wearing the shoulder pads 100.

Each of the straps $\mathbf{10}_1$, $\mathbf{10}_2$ covers a span between first and second parts of the shoulder pads 100 separated by a space 114. In this example, each of the straps $\mathbf{10}_1$, $\mathbf{10}_2$ covers the span between the front part 102 and the rear part 104 of the shoulder pads 100. Each of the straps $\mathbf{10}_1$, $\mathbf{10}_2$ comprises a first (proximal) end portion 12 and a second (distal) end portion 14, the first end portion 12 being affixed to the shoulder pads 100 and the second end portion 14 being detachably affixed to the shoulder pads 100. In this instance, the first end portion 12 of each of the straps $\mathbf{10}_1$, $\mathbf{10}_2$ is affixed to the rear part 104 and the second end portion 14 of each of the straps $\mathbf{10}_1$, $\mathbf{10}_2$ is detachably affixed to the front part 102. It is understood that the first end portion 12 is "permanently" affixed to the first part (rear part 104) using any method known in the art such as lamination, stitching, gluing, needling, overmolding, thermal bonding, high-frequency bonding, vibration bonding, ultrasonic bonding or any combination thereof such that, in use, the strap is not detachable from the garment (shoulder pads). On the other end, in use, the second end portion 14 is detachably affixed to the second part (front part 102) such that the second end portion 14 is detachable from the garment (shoulder pads). Each of the left and right straps $\mathbf{10}_1$, $\mathbf{10}_2$ thus allows adjustment of the front and rear parts 102, 104 in the front-back direction of the shoulder pads 100.

Each of the straps $\mathbf{10}_1$, $\mathbf{10}_2$ comprises a first (outer) layer 16 and a second (inner) layer 18 that may be held together by a binding element 20, a padding element 22 confined therein for providing impact protection to the player, and an affixing means 24 for adjusting and securing the strap.

Figure 6:
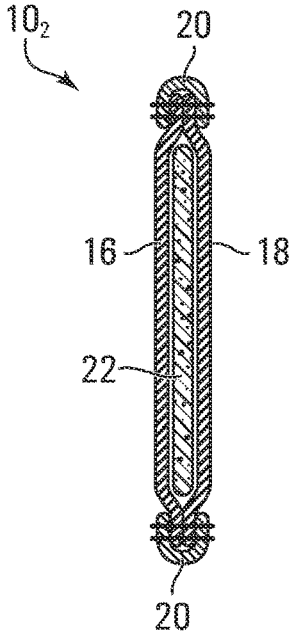
FIG. 6 is a cross-sectional view of the right strap taken along lines 6-6 in FIG. 5A.
Figure 7:
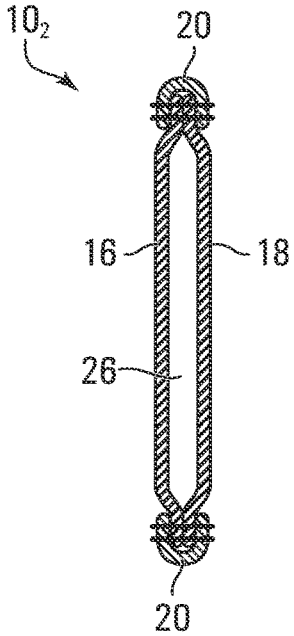
FIG. 7 is a cross-sectional view of the right strap taken along lines 7-7 in FIG. 5B.

As best shown in FIGS. 6 and 7, the first and second layers 16, 18 define a generally rectangular shape with a hollow space 26 defined between these layers and in which the padding element 22 is confined. Each of the first and second layers 16, 18 is made of stretchable material that comprises elastic "stretch" fabric (e.g. spandex, nylon, etc.). For example, each of the first and second layers 16, 18 may be a stretchable fabric that may comprise a blend of a synthetic fiber and at least 10% of a stretchable fiber or it may be made of a blend of fibers selected from the group consisting of acetate, acrylic, nylon, olefin, polyester and rayon fibers with more than 10% spandex fibers or other elastic fibers such as LYCRA™. The stretchable fabric can be a four-way stretch 85% nylon 15% spandex blend.

Figure 3A:
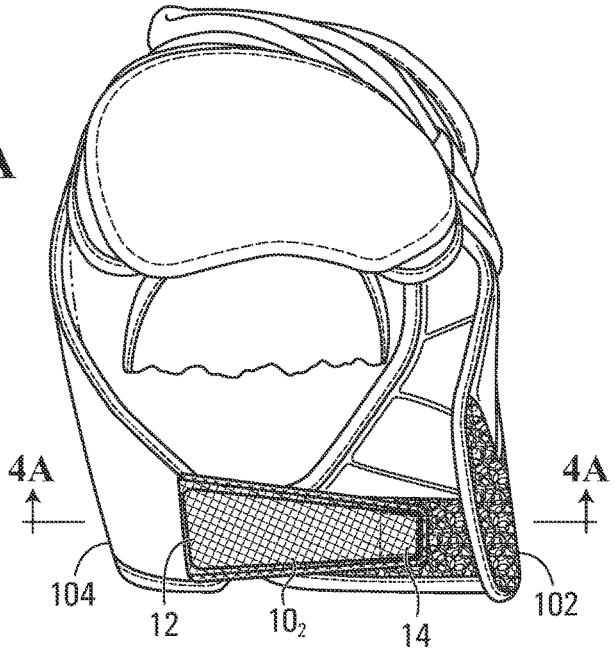
FIG. 3A is a perspective side view of the protective sport garment of FIG. 1, with a part broken away, and with the right strap in a first position and a first length.
Figure 3B:
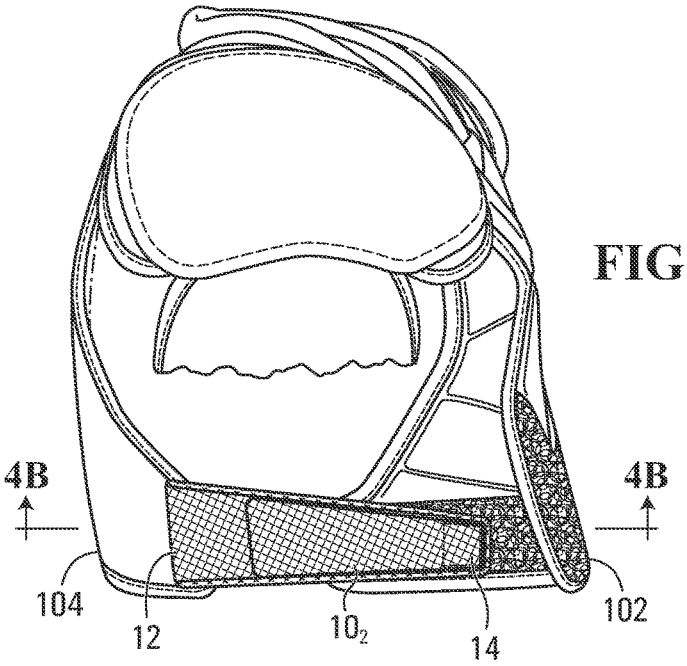
FIG. 3B is a perspective side view of the protective sport garment of FIG. 1, with a part broken away, and with the right strap in a second position and a second length.
Figure 4A:
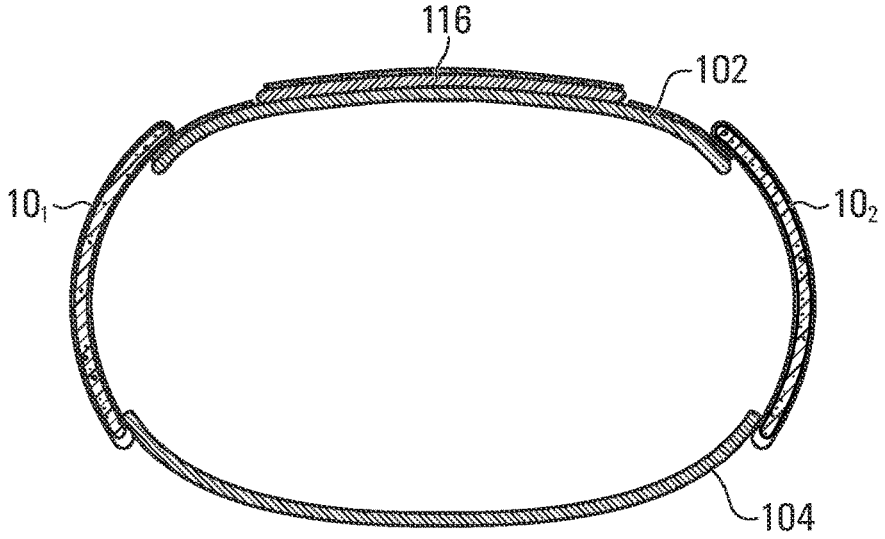
FIG. 4A is a cross-sectional view of the protective sport garment of FIG. 3A taken along lines 4A-4A and showing the left and right straps in the first position.
Figure 4B:
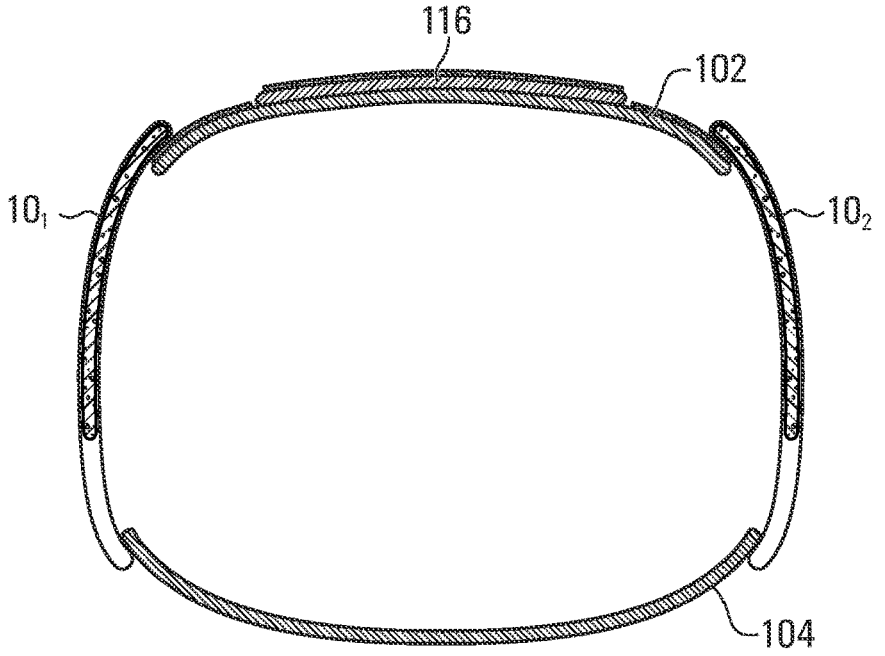
FIG. 4B is a cross-sectional view of the protective sport garment of FIG. 3B taken along lines 4B-4B and showing the left and right straps in the second position.
Figure 5A:
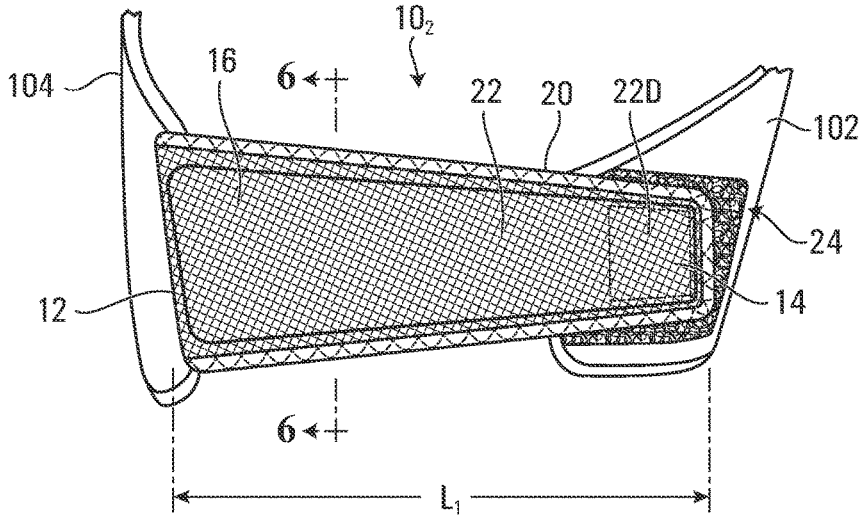
FIG. 5A is an enlarged perspective side view of the protective sport garment of FIG. 3A, with parts broken away, and with the right strap in the first position and the first length.
Figure 5B:
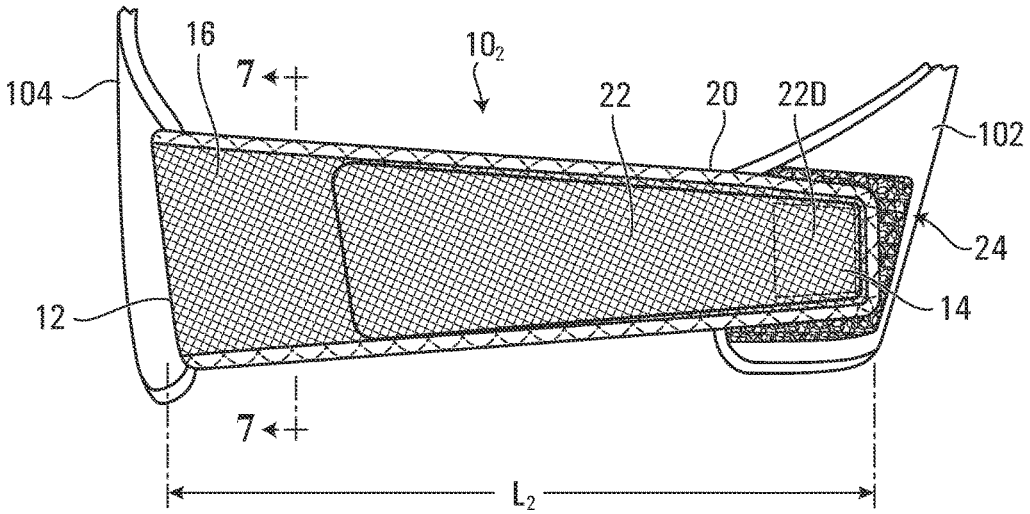
FIG. 5B is an enlarged perspective side view of the protective sport garment of FIG. 3B, with parts broken away, and with the right strap in the second position and the second length.

In use, each of the straps $10_1$, $10_2$ is movable from a first position, as shown in FIGS. 3A, 4A and 5A, to a second (extended) position, as shown in FIGS. 3B, 4B and 5B. Each of the straps $10_1$, $10_2$ has a first length $L_1$ in the first position and a second length $L_2$ in the second position, the second length $L_2$ being different (longer) from the first length $L_1$. Moreover, because the first end portion 12 is affixed to one of the first and second parts (e.g. rear part 104) and the second end portion 14 is detachably affixed at a selected location on the other one of the first and second parts (e.g. front part 102), in use, the strap is movable (stretchable) between the first and second lengths $L_1$, $L_2$ for allowing the second end portion 14 to be affixed at a selected location on the front part 102 for allowing adjustability of the front and rear parts 102, 104, i.e. in order to adjust the rear part 104 relative to the front part 102 such that the player may adjust the shoulder pads 100 according to the size of his/her upper body. Moreover, because each of the layers 16, 18 is made of stretchable material, in use, the strap conforms to the player's (upper) body. The strap thus connects together the front and rear parts 102, 104 once the second end portion 14 of the strap is affixed at the selected location on the front part 102. It is understood that the first end portion 12 of the strap may rather be (permanently) affixed to the front part 102 and the second end portion 14 may rather be detachably affixed at a selected location on the rear part 104.

The binding element 20 is also made of a stretchable material; however, it may be less stretchable while offering further resistance at the periphery of the strap. For example, the binding element 20 may be a strip of fabric, band of material, or braiding that may be made of woven polyester fabric, woven nylon fabric, spandex, or any other suitable material. The binding element 20 can be affixed to the first and second layers 16, 18 in various ways. For example, the binding element 20 may be affixed to the first and second layers 16, 18 by a stitching where the stitching extends through the binding element 20 and each layer in order to affix the layers to the binding elements. The binding element 20 may extend along a majority of the perimeter of the layers in order to affix together the layers along their respective edge portions. In this example, the binding element 20 affixes or secures together the first and second layers 16, 18 at their upper edge portions and at their bottom edge portions as best shown in FIGS. 6 and 7. However, as best shown in FIGS. 5A and 5B, the binding element 20 may also affix or secure together the first and second layers 16, 18 at their end edge portions i.e. at the second (distal) end portion 14 of the strap. It is also understood that the binding element 20 may be omitted and that the first and second layers may then be affixed together along their edges by any method known in the art such as lamination, stitching, gluing, needling, overmolding, thermal bonding, high-frequency bonding, vibration bonding, ultra-sonically bonding or any combination thereof. Alternatively, it is also understood that the first and second layers may be integrally formed together while still defining a hollow space in which the padding element 22 is received or confined. For example, the layers may take the form of a sock in which the padding element 22 is received.

The padding element 22 may be affixed to the second end portion 14 of the strap 10 by stitching, glue or any appropriate adhesive. For example, a distal end 22D of the padding element 22 may be affixed by stitching to the first layer and/or the second layer 18 at the second end portion 14 of the strap 10. However, the padding element 22 may alternatively be affixed to the first and second layers 16, 18 at other locations of the strap 10.

In accordance with another embodiment, the padding element may be confined within the first and second layers 16, 18 but not affixed to these layers. In this case, the padding element would be snuggly retained within the first and second layers 16, 18 and would not be stitched, glued or otherwise attached to the layers The shape of the padding element 22 generally follows an outline of the strap 10 so as to cover a maximum surface area therein. In some embodiments, the padding element 22 may comprise a plurality of padding portions. For example, the padding element 22 may comprise two, three, four or more padding portions.

Furthermore, the padding element 22 may comprise a rigid or semi-rigid material such as a polymer (e.g. nylon, polyester, etc.) or a composite (e.g. carbon fiber, Kevlar, etc.). In some embodiments, the padding element 22 may instead comprise a foam material. For instance, the foam material of the padding element 22 may comprise any suitable foam. For example, the foam material of the padding element 22 may comprise ethylene vinyl acetate (EVA) foam, expanded polypropylene (EPP) foam, expanded polyethylene (EPE) foam, vinyl nitrile (VN) foam, or any other suitable foam. In some cases, the foam material of the padding element 22 may include only one type of foam. In other cases, the foam material of the padding element 22 may include different types of foam in different areas of the strap 10. Also, in some embodiments, the padding element 22 may comprise other shock-absorbing materials. For instance, in some cases, the padding element 22 may comprise gel material. In addition, in some embodiments, the padding element 22 may comprise a combination of the above mentioned materials whereby different types of material are located in different areas of the strap 10.

The affixing means 24 comprises mating components such as a first connector and a second connector. In this embodiment, the affixing means 24 comprises a hook-and-loop fastener. For instance, the inner side (second (inner) layer 18) of the strap may have a tab or a band with VELCRO hooks 26 at the second end portion 14 and the front part 102 may have a tab or a band with VELCRO loops 28. The tab or band with VELCRO hooks or loops may be affixed to the strap or shoulder pads by stitching, glue or any other suitable adhesive.

In the released position shown in FIG. 2, the VELCRO hooks 26 do not engage the VELCRO loops 28 and the player can adjust the strap according to the appropriate length. Once the appropriate length is obtained, the VELCRO hooks 26 of the second end portion 14 are affixed at a selected location of the VELCRO loops 28 in order to adjust the rear part 104 relative to the front part 102. As such, in this position, the VELCRO loops and hooks 26, 28 engage together for maintaining in place the strap and the front and rear parts 102, 104.

In other embodiments, the affixing means may instead comprise a clip or any other means to affix the second end portion of the strap to the front part of the shoulder pads 100.

FIGS. 8A to 10 show a right strap 210 constructed in accordance with a second embodiment of the invention. The strap 210 comprises a first (proximal) end portion 212 and a second (distal) end portion 214. The strap 210 also comprises first and second layers 216, 218 that may be held together by a binding element 220, a padding element, and an affixing means 224 at the second end portion 214. The padding element is confined in a hollow space between the first and second layers 216, 218 and comprises first and second padding elements 226, 228.

The first padding element 226 has a proximal end portion 226P and a distal end portion 226D that is adjacent the second end portion 214 of the strap 210 and the second padding element 228 has a proximal end portion 228P that is adjacent the first end portion 212 of the strap 210. The first padding element 226 is similar in construction to the padding element 22 described above and may have its distal end portion 226D attached by stitching, glue or any appropriate adhesive to the second end portion 214 of the strap 210. The proximal end portion 228P of the second padding element 228 may be attached by stitching, glue or any appropriate adhesive to the first end portion 212 of the strap 210. As for the straps $\mathbf{10}_1$, $\mathbf{10}_2$, because the first end portion 212 is affixed to one of the first and second parts (e.g. rear part 104) and the second end portion 214 is detachably affixed at a selected location on the other one of the first and second parts (e.g. front part 102), in use, the strap 210 is movable (stretchable) between first and second lengths $L_1$, $L_2$ for allowing the second end portion 214 to be affixed at a selected location on the front part 102 for allowing adjustability of the front and rear parts 102, 104.

Figure 9:
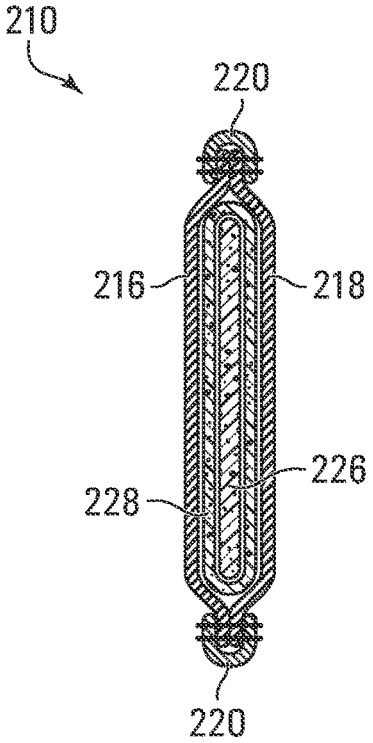
FIG. 9 is a cross-sectional view of the right strap taken along lines 9-9 in FIG. 8A.
Figure 10:
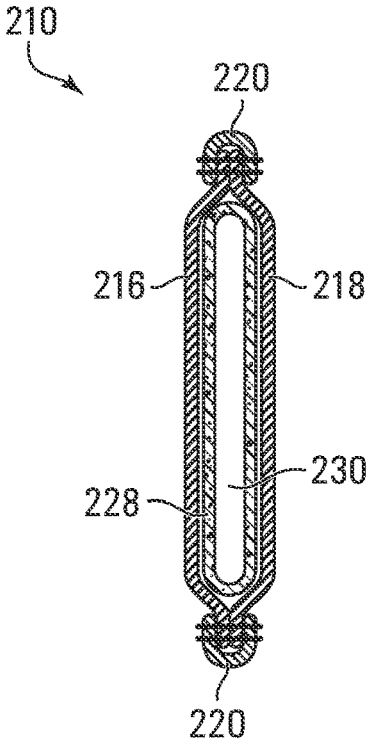
FIG. 10 is a cross-sectional view of the right strap taken along lines 10-10 in FIG. 8B.

As seen in FIGS. 9 and 10, the second padding element 228 defines a cavity 230 for at least partially receiving the first padding element 226. The second padding element 228 is generally rectangular and the cavity 230 has a cross-sectional area larger than a cross-sectional area of the first padding element 226 for at least partially receiving the first padding element 226 within the cavity 230.

Figure 8A:
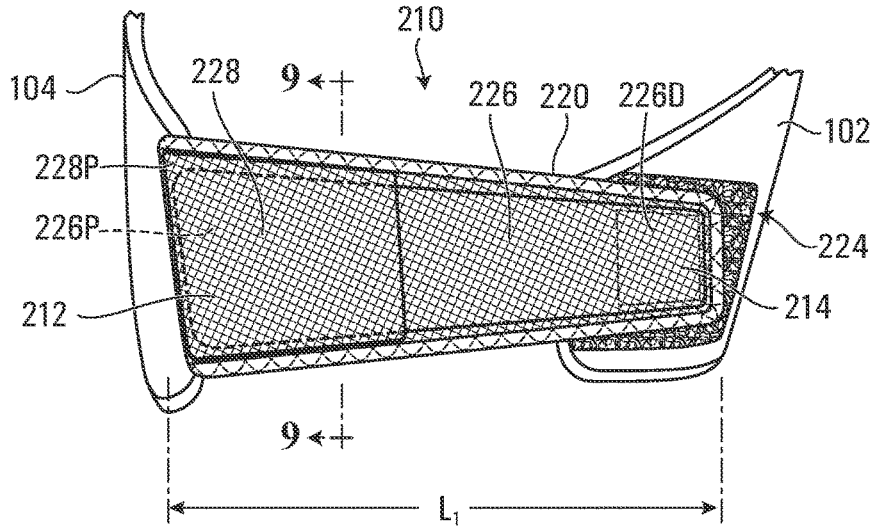
FIG. 8A is an enlarged perspective side view of a protective sport garment with parts broken away and with a right strap constructed in accordance with a second embodiment of the invention, the right strap being in a first position and a first length.
Figure 8B:
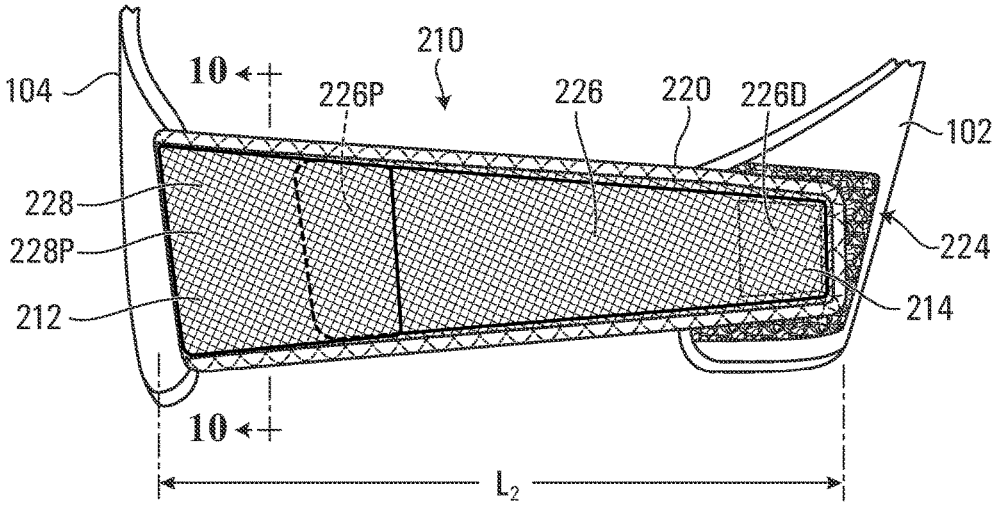
FIG. 8B is an enlarged perspective side view of the protective sport garment with parts broken away and with the right strap constructed in accordance with the second embodiment in a second position and a second length.

The first and second layers 216, 218 are of similar construction to first and second layers 16, 18 previously described which allow the strap 210 to be movable from a first position, as shown in FIG. 8A, to a second position, as shown in FIG. 8B. This entails that the strap 210 can have the first length $L_1$ in the first position, the second different length $L_2$ in the second position, and in use, the strap 210 is movable between the first and second lengths $L_1$, $L_2$ for allowing the second end portion 214 to be affixed at the selected location of the front part 102 in order to adjust the rear part 104 relative to the front part 102 while the proximal end portion 226P of the first padding element 226 remains within the cavity 230 defined by the second padding element 228 when the strap 210 is moved from the first length $L_1$ to the second length $L_2$.

The cavity 230 thus permits an interface between the first padding element 226 and the second padding element 228 such that the proximal end portion 226P of the first padding element 226 remains within the cavity 230 when the strap is moved from the first length $L_1$ to the second length $L_2$. As best seen in FIG. 8B, this feature allows the first and second padding elements 226, 228 to cover a totality of the surface area of the strap 210 even when the strap 210 stretches to the second (extended) position.

The first padding element 226 may comprise a rigid or semi-rigid material such as a polymer (e.g. nylon, polyester, etc.) or a composite (e.g. carbon fiber, Kevlar, etc.). In some embodiments, the first padding element 226 may instead comprise a foam material such as ethylene vinyl acetate (EVA) foam, expanded polypropylene (EPP) foam, expanded polyethylene (EPE) foam, vinyl nitrile (VN) foam, or any other suitable foam. The second padding element 228 may be made of similar materials as the first padding element 226. However, because of the presence of the cavity 230 in the second padding element 228, the second padding element 228 may be made of plastic or other materials more suitable for making this element by a molding process.

FIGS. 11A to 13 show a right strap 310 constructed in accordance with a third embodiment of the invention. The strap 310 comprises a first (proximal) end portion 312 and a second (distal) end portion 314. The strap 310 also comprises first and second layers 316, 318 that may be held together by a binding element 320, a padding element, and an affixing means 324 at the second end portion 314. The padding element is confined in a hollow space 322 between the first and second layers 316, 318 and comprises first and second padding elements 326, 328.

The first padding element 326 has a proximal end portion 326P and a distal end portion 326D that is adjacent the second end portion 314 of the strap 310 and the second padding element 328 has a proximal end portion 328P that is adjacent the first end portion 312 of the strap 310 and a distal end portion 328D that at least partially overlaps the first padding element 326. The first padding element 326 is similar in construction to the padding element 22 described above and may have its distal end portion 326D attached by stitching, glue or any appropriate adhesive to the second end portion 314 of the strap 310. The proximal end portion 328P of the second padding element 328 may be attached by stitching, glue or any appropriate adhesive to the first end portion 312 of the strap 310. As for the straps $\mathbf{10}_1$, $\mathbf{10}_2$, because the first end portion 312 is affixed to one of the first and second parts (e.g. rear part 104) and the second end portion 314 is detachably affixed at a selected location on the other one of the first and second parts (e.g. front part 102), in use, the strap 310 is movable (stretchable) between first and second lengths $L_1$, $L_2$ for allowing the second end portion 314 to be affixed at a selected location on the front part 102 for allowing adjustability of the front and rear parts 102, 104.

Figure 11A:
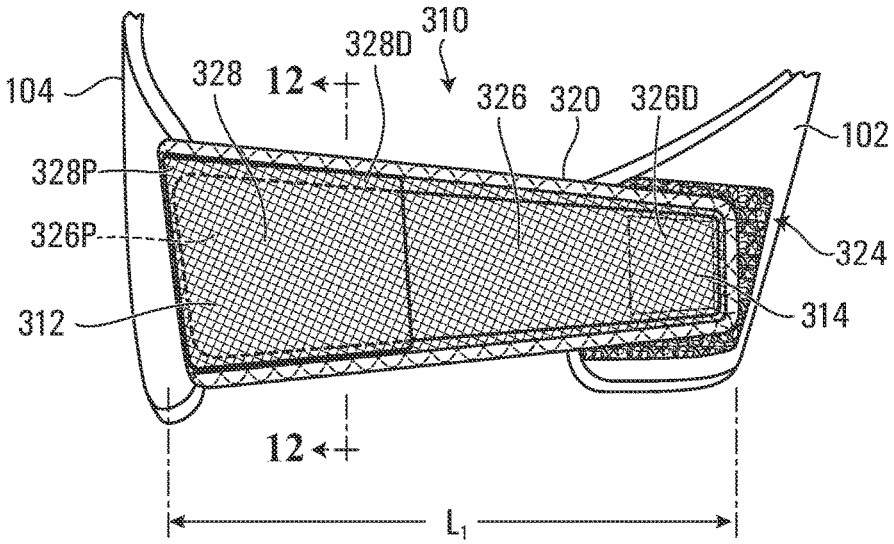
FIG. 11A is an enlarged perspective side view of a protective sport garment with parts broken away and with a right strap constructed in accordance with a third embodiment of the invention, the right strap being in a first position and a first length.
Figure 11B:
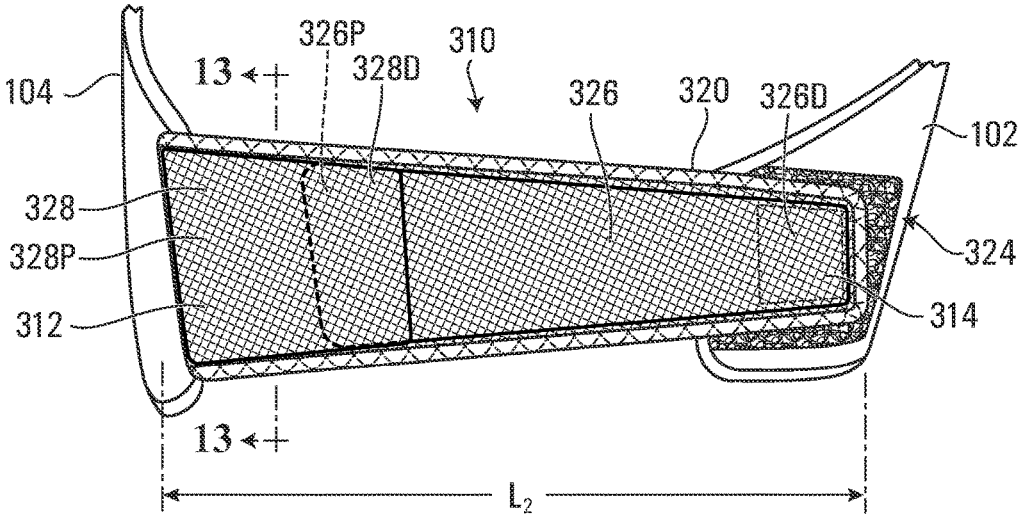
FIG. 11B is an enlarged perspective side view of the protective sport garment with parts broken away and with the right strap constructed in accordance with the third embodiment in a second position and a second length.
Figure 12:
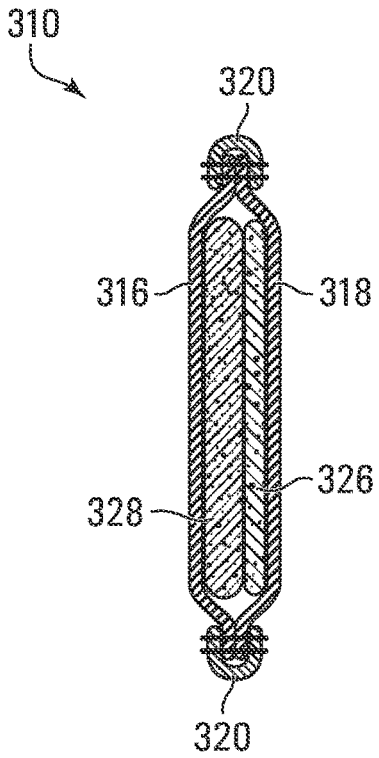
FIG. 12 is a cross-sectional view of the right strap taken along lines 12-12 in FIG. 11A.
Figure 13:
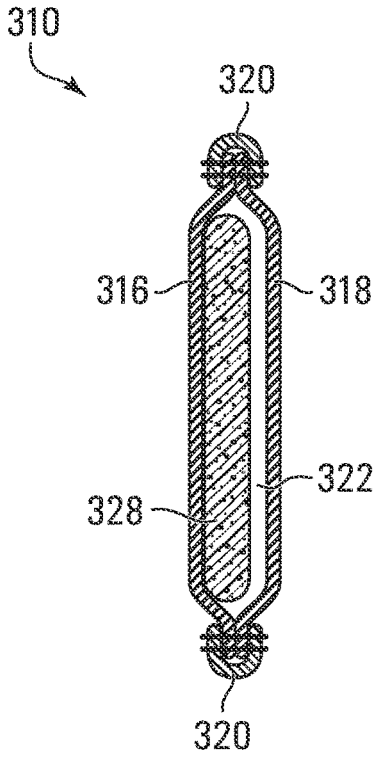
FIG. 13 is a cross-sectional view of the right strap taken along lines 13-13 in FIG. 11B.

The second padding element 328 at least partially overlaps the first padding element 326 such that, in use, the first and second padding elements 326, 328 define a first overlap when the first and second padding elements 326, 328 are in a first position and the strap is in a first length $L_1$ (see FIGS. 11A and 12), the strap 310 is movable between the first length $L_1$ and the second length $L_2$ for allowing the second end portion 314 to be affixed at the selected location for allowing adjustability of the first and second parts 102, 104, and the first and second padding elements 326, 328 define a second overlap when the first and second padding elements 326, 328 are in a second position and the strap 310 is in the second length $L_2$ (see FIG. 11B). The second length $L_2$ is greater than the first length $L_1$ and the first overlap is greater than the second overlap.

The first and second layers 316, 318 are of similar construction to the first and second layers 16, 18 previously described which allow the strap 310 to be movable from a first position, as shown in FIG. 11A, to a second position, as shown in FIG. 11. This entails that the strap 310 can have the first length $L_1$ in the first position, the second different length $L_2$ in the second position, and in use, the strap 310 is movable between the first and second lengths $L_1$, $L_2$ for allowing the second end portion 314 to be affixed at the selected location of the front part 102 in order to adjust the rear part 104 relative to the front part 102 while the distal end portion 328D of the second padding element 328 at least partially covers the first padding element 326 when the strap is moved from the first length $L_1$ to the second length $L_2$.

The overlapping construction thus permits an interface between the first padding element 326 and the second padding element 328 such that the distal end portion 328D of the second padding element 328 at least partially covers the first padding element 326 when the strap is moved from the first length $L_1$ to the second length $L_2$. As best seen in FIG. 11B, this feature allows the first and second padding elements 326, 328 to cover a totality of the surface area of the strap 310 even when the strap 310 is moved to the second (extended) position (in the second length $L_2$).

The first padding element 326 may comprise a foam material such as ethylene vinyl acetate (EVA) foam, expanded polypropylene (EPP) foam, expanded polyethylene (EPE) foam, vinyl nitrile (VN) foam, or any other suitable foam. The second padding element 328 may be made of similar materials as the first padding element 326.

Any feature of any embodiment discussed herein may be combined with any feature of any other embodiment discussed herein in some examples of implementation. Various embodiments and examples have been presented for the purpose of describing, but not limiting, the invention. Various modifications and enhancements will become apparent to those of ordinary skill in the art and are within the scope of the invention, which is defined by the appended claims.

The invention claimed is:

1. A strap for a protective sport garment wearable by a wearer, the garment comprising at least first and second parts separated by a space, the strap comprising:

first and second layers made of stretchable material, the first and second layers defining a hollow space therebetween; and a padding element confined in the hollow space for offering impact protection to the wearer wearing the garment;

wherein the strap comprises a first end portion configured to be affixed to one of the first and second parts of the garment and a second end portion configured to be detachably affixed to a selected location on the other one of the first and second parts of the garment, wherein the padding element has a first end and a second end, the second end of the padding element being affixed to the second end portion of the strap, the first end of the padding element being free to move relative to the first end portion of the strap; and wherein the strap is configurable in a less stretched position and in a more stretched position and wherein, in the more stretched position, the first end of the padding element is further from the first end portion of the strap than in the less stretched position.

2. A strap as defined in claim 1, wherein the padding element is retained within the first and second layers.

3. A strap as defined in claim 1, wherein the padding element is affixed to one of the first and second layers or to the first and second layers.

4. A strap as defined in claim 1, wherein the first and second layers are affixed together along their upper and lower edge portions.

5. A strap as defined in claim 4, wherein each of the first and second layers comprises an end edge portion, the first and second layers being affixed together at their end edge portions at the second end portion of the strap.

6. A strap as defined in claim 1, wherein the strap comprises a binding element affixing together the first and second layers along their upper and lower edge portions.

7. A strap as defined in claim 6, wherein each of the first and second layers comprises an end edge portion, the binding element affixing together the first and second layers at their end edge portions at the second end portion of the strap.

8. A strap as defined in claim 7, wherein the binding element comprises a strip of fabric, a band of material or a braiding.

9. A strap as defined in claim 1, wherein the second length is greater than the first length.

10. A strap as defined in claim 1, wherein the first and second layers are integrally formed together.

11. A strap as defined in claim 1, wherein, once the second end portion of the strap is affixed, the strap is configured to conform to the wearer's body.

12. A strap as defined in claim 1, wherein the padding element is a first padding element and the strap further comprises a second padding element confined in the hollow space, the first padding element having a proximal end portion and a distal end portion that is affixed at the second end portion of the strap and the second padding element having a proximal end portion affixed at the first end portion of the strap, the second padding element defining a cavity for at least partially receiving the first padding element such that the proximal end portion of the first padding element remains within the cavity defined by the second padding element when the strap is adjusted from the first length to the second length.

13. A strap for a protective sport garment wearable by a wearer, the garment comprising at least first and second parts separated by a space, the strap comprising:

first and second layers made of stretchable material, the first and second layers defining a hollow space therebetween; and first and second padding elements confined in the hollow space for offering impact protection to the wearer wearing the garment;

wherein the strap comprises a first end portion configured to be affixed to one of the first and second parts of the garment and a second end portion configured to be detachably affixed at a selected location on the other one of the first and second parts of the garment, the first padding element having a proximal end portion and a distal end portion that is adjacent the second end portion of the strap and the second padding element having a proximal end portion adjacent the first end portion of the strap, and a distal end portion adjacent the second end portion of the strap the second padding element defining a cavity for at least partially receiving the first padding element; and wherein the proximal end portion of the first padding element is configured to be free to move relative to the first end portion of the strap and relative to the proximal end portion of the second padding element, the distal end portion of the first padding element is affixed to the second portion of the strap, and wherein the strap is adjustable between a less stretched position and a more stretched position for allowing the second end portion to be affixed to the selected location while the proximal end portion of the first padding element remains within the cavity defined by the second padding element.

14. A strap as defined in claim 13, wherein the first and second padding elements are retained within the first and second layers.

15. A strap as defined in claim 13, wherein the distal end portion of the first padding element is affixed at the second end portion of the strap and the proximal end portion of the second padding element is affixed at the first end portion of the strap.

16. A strap as defined in claim 13, wherein the first and second layers are affixed together along their upper and lower edge portions.

17. A strap as defined in claim 16, wherein each of the first and second layers comprises an end edge portion, the first and second layers being affixed together at their end edge portions at the second end portion of the strap.

18. A strap as defined in claim 13, wherein the strap comprises a binding element affixing together the first and second layers along their upper and lower edge portions.

19. A strap as defined in claim 18, wherein each of the first and second layers comprises an end edge portion, the binding element affixing together the first and second layers at their end edge portions at the second end portion of the strap.

20. A strap as defined in claim 19, wherein the binding element comprises a strip of fabric, a band of material or a braiding.

21. A strap as defined in claim 13, wherein the second length is greater than the first length.

22. A strap as defined in claim 13, wherein the first and second layers are integrally formed together.

23. A strap as defined in claim 13, wherein, once the second end portion of the strap is affixed, the strap is configured to conform to the wearer's body.

24. A strap for a protective sport garment wearable by a wearer, the garment comprising at least first and second parts separated by a space, the strap comprising:

first and second layers made of stretchable material, the first and second layers defining a hollow space therebetween; and first and second padding elements confined in the hollow space for offering impact protection to the wearer wearing the garment;

wherein the strap comprises a first end portion configured to be affixed to one of the first and second parts of the garment and a second end portion configured to be detachably affixed at a selected location on the other one of the first and second parts of the garment, the first padding element having a distal end portion adjacent the second end portion of the strap and the second padding element having a proximal end portion adjacent the first end portion of the strap;

wherein the strap is configurable in a less stretched position and in a more stretched position in a direction of stretching and wherein the first and second padding elements define a first amount of overlap within the hollow space in the direction of stretching when the strap is in the less stretched position; and the first and second padding elements define a second amount of overlap within the hollow space in the direction of stretching when the strap is in the more stretched position, the second amount of overlap being less than the first amount of overlap.

25. A strap as defined in claim 24, wherein the second length is greater than the first length and the first overlap is greater than the second overlap.

26. A strap as defined in claim 24, wherein the first and second padding elements are retained within the first and second layers.

27. A strap as defined in claim 24, wherein the distal end portion of the first padding element is affixed at the second end portion of the strap and the proximal end portion of the second padding element is affixed at the first end portion of the strap.

28. A strap as defined in claim 24, wherein each of the first and second layers comprises an end edge portion, the strap comprising a binding element affixing together the first and second layers along their upper and lower edge portions and at their end edge portions at the second end portion of the strap.

29. A strap as defined in claim 24, wherein the first and second layers are integrally formed together.

30. A strap as defined in claim 24, wherein, once the second end portion of the strap is affixed, the strap is configured to conform to the wearer's body.

31. A strap as defined in claim 24, wherein the first and second padding elements are made of foam.

32. A strap as defined in claim 24, wherein the stretchable material of the first and second layers is made of spandex, nylon, or a blend of synthetic fibers and stretchable fibers.

33. A protective sport garment comprising a strap as defined in claim 1.

34. A protective sport garment as defined in claim 33, wherein the protective sport garment is shoulder pads.

35. A protective sport garment as defined in claim 34, wherein the first and second parts of the protective sport garment are respectively front and rear parts of the shoulder pads.

36. A protective sport garment as defined in claim 33, wherein the protective sport garment is configured to be worn on at least part of a leg of the wearer.

37. A strap for a protective sport garment wearable by a wearer, comprising first and second parts, the strap comprising:

strap material including a first end portion configured to be affixed to the first part of the protective sport garment and a second end portion detachably affixable to the second part of the protective sport garment, the strap material defining a channel between the first and second end portions; and a padding element disposed in the channel for providing impact protection to the wearer of the protective sport garment;

wherein the strap material has a first portion that is fixed relative to the padding element and a second portion that is free to move relative to the padding element and is configured to move further away from an end of the padding element when the strap is stretched.

38. A strap for a protective sport garment as defined in claim 37, wherein the first and second parts are separated by a space and the second end portion of the strap material is configured to be detachably affixable to the second part of the protective sport garment to bridge the space when affixed.

39. A strap for a protective sport garment as defined in claim 37, wherein the strap material is stretchable material.

40. A strap for a protective sport garment as defined in claim 39, wherein stretching of the strap to affix the second end portion of the stretchable material to the second part of the protective sport garment causes relative movement between the stretchable material and the padding element.

41. A strap for a protective sport garment as defined in claim 39, wherein the padding element is affixed to the stretchable material.

42. A strap for a protective sport garment as defined in claim 39, wherein the stretchable material comprises fabric.

43. A strap for a protective sport garment as defined in claim 39, wherein the padding element comprises foam.

44. A strap for a protective sport garment as defined in claim 39, wherein the padding element comprises a rigid or semi-rigid material.

45. A strap for a protective sport garment as defined in claim 37, wherein the padding element is a first padding element, the strap comprises a second padding element disposed in the channel for providing impact protection to the wearer of the protective sport garment, and the strap material and the second padding element are movable relative to one another.

46. A strap for a protective sport garment as defined in claim 45, wherein the strap material is stretchable material, and stretching of the strap to affix the second end portion of the stretchable material to the second part of the protective sport garment causes relative movement between the stretchable material and the first padding element and relative movement between the stretchable material and the second padding element.

47. A strap for a protective sport garment as defined in claim 46, wherein the first padding element and the second padding element are secured to one another.

48. A strap for a protective sport garment as defined in claim 46, wherein the first padding element and the second padding element overlap during the relative movement between the stretchable material and the first padding element and the relative movement between the stretchable material and the second padding element.

49. A strap for a protective sport garment as defined in claim 37, wherein the protective sport garment is shoulder pads.

50. A strap for a protective sport garment as defined in claim 49, wherein the first and second parts of the protective sport garment are respectively front and rear parts of the shoulder pads.

51. A strap for a protective sport garment as defined in claim 37, wherein the protective sport garment is configured to be worn on at least part of a leg of the wearer.

* * * * *